US008500483B2

(12) United States Patent
Heise et al.

(10) Patent No.: US 8,500,483 B2
(45) Date of Patent: Aug. 6, 2013

(54) PLUG OF A PLUG CONNECTOR

(75) Inventors: Manfred Heise, Bamberg (DE); Peter Laube, Höchstadt/Aisch (DE); Eugen Noppenberger, Heroldsbach (DE)

(73) Assignee: Siemens Aktiengesellschaft, München (DE)

( * ) Notice: Subject to any disclaimer, the term of this patent is extended or adjusted under 35 U.S.C. 154(b) by 248 days.

(21) Appl. No.: 12/996,126

(22) PCT Filed: Apr. 8, 2009

(86) PCT No.: PCT/EP2009/054247

§ 371 (c)(1),
(2), (4) Date: Dec. 3, 2010

(87) PCT Pub. No.: WO2009/146968

PCT Pub. Date: Dec. 10, 2009

(65) Prior Publication Data

US 2011/0081800 A1 Apr. 7, 2011

(30) Foreign Application Priority Data

Jun. 6, 2008 (DE) ..... 10 2008 027 109
Jul. 7, 2008 (DE) ..... 10 2008 031 990

(51) Int. Cl.
*H01R 13/58* (2006.01)

(52) U.S. Cl.
USPC ..... 439/460; 439/607.41

(58) Field of Classification Search
USPC ..... 439/460, 465, 467–470, 497, 607.41, 439/607.47
See application file for complete search history.

(56) References Cited

U.S. PATENT DOCUMENTS

| | | | | |
|---|---|---|---|---|
| 4,804,342 | A * | 2/1989 | Rudy et al. | 439/467 |
| 5,195,909 | A * | 3/1993 | Huss et al. | 439/465 |
| 5,244,407 | A * | 9/1993 | Volk et al. | 439/460 |
| 6,056,597 | A | 5/2000 | Dent et al. | |
| 7,112,086 | B1 * | 9/2006 | Wu | 439/460 |
| 7,137,848 | B1 * | 11/2006 | Trout et al. | 439/465 |
| 7,507,121 | B1 * | 3/2009 | Scea et al. | 439/607.41 |
| 7,513,799 | B1 * | 4/2009 | Goldman | 439/607.41 |

FOREIGN PATENT DOCUMENTS

| | | | |
|---|---|---|---|
| DE | 3438419 | A1 | 4/1986 |
| DE | 9412547 | U1 | 9/1994 |
| DE | 29514607 | U1 | 11/1995 |
| DE | 19606050 | A1 | 8/1997 |
| EP | 0561143 | A1 | 9/1993 |
| EP | 1309040 | A1 | 5/2003 |

* cited by examiner

*Primary Examiner* — Xuong Chung Trans
(74) *Attorney, Agent, or Firm* — Henry M. Feiereisen LLC

(57) ABSTRACT

A plug, in particular a high-pole plug, of a plug-type connector is disclosed for a number of multi-core, shielded cables, of whose lines are electrically conductively connected to contacts of a contact strip cable shields are electrically conductively connected to a shield support. The contact strip and the shield support are arranged physically at a distance from one another in a shroud. The shield support is electrically connected to an ground connection of the plug. Two shielding brackets are provided as the shield support and connected to one another in a releasable manner. These shielding brackets are formed in such a way as to form a holding area for cable clamps which can be clamped between these shielding brackets. As a result, a plug of this type can accommodate a contact strip with a high pole number, without the need to modify the dimensions of the shroud of the plug.

9 Claims, 2 Drawing Sheets

PLUG OF A PLUG CONNECTOR

CROSS-REFERENCES TO RELATED APPLICATIONS

This application is the U.S. National Stage of International Application No. PCT/EP2009/054247, filed Apr. 8, 2009, which designated the United States and has been published as International Publication No. WO 2009/146968 and which claims the priorities of German Patent Applications, Serial Nos. 10 2008 027 109.8, filed Jun. 6, 2008, and 10 2008 031 990.2, filed Jul. 7, 2008, pursuant to 35 U.S.C. 119(a)-(d).

BACKGROUND OF THE INVENTION

The invention relates to a plug of a plug connector.

A plug of this generic type, in particular a multipole plug, of a plug connector for a plurality of multicore, shielded cables, is commercially available and is illustrated schematically in FIG. 1. In this FIG. 2 denotes a shroud, 6 a contact strip, 8 a shield support and 10 a multicore, shielded cable, in each case. This contact strip 6 with the shield support 8 and the shroud 2 can be detachably connected to one another and form the plug of this generic type of a plug connector. In order to ensure that the multicore, shielded cables 10 enter the interior of this shroud 2, this shroud 2 has a recess 12. The contact strip 6 may be in the form of a male or female connector strip. Each cable 10 is electrically conductively connected by its cable shield, by means of a cable clamp 16, to a bracket of the shield support 8. Each cable clamp 16 is detachably connected by means of two screws 18, 20 to the bracket of this shield support 8. Each line of a multicore, shielded cable 10 is electrically conductively connected to a contact on the contact strip 6. These lines are not illustrated, for clarity reasons. The bracket of the shield support 8 is on the one hand electrically conductively connected to a ground connection in the contact strip 6 by means of a web 22 and 24, and on the other hand is arranged physically at a distance from the contact strip 6. In one advantageous embodiment, the bracket of the shield support 8 and the two webs 22 and 24 form a unit. In order to fix the contact strip 6 to the shield support 8 at the side, a plurality of attachment apparatuses 26 and 28 are provided in the shroud 2. These attachment apparatuses 26 and 28 are in the form of ribs, thus stiffening the shroud 2. Threaded holes for holding attachment screws are provided in the end faces of these attachment apparatuses 26 and 28. This prevents mechanical loads from being applied to the contacts in the contact strip 6.

As can be seen from this plug of a plug connector as illustrated in FIG. 1, the shield support 8 provides space only for a limited number of cable clamps 16. As the number of poles on the contact strip 6 increases continuously, these known plugs of a plug connector are reaching their limit.

SUMMARY OF THE INVENTION

The invention is now based on the object of developing a known plug of a plug connector such that the shield support is enlarged considerably, without changing the dimensions of this known plug.

According the invention, this object is achieved by a plug, in particular a multipole plug, of a plug connector for a number of multicore, shielded cables, whose lines are electrically conductively connected to contacts on a contact strip in the plug of a plug connector and whose cable shields are electrically conductively connected to a shield support, wherein the contact strip and the shield support are arranged physically at a distance from one another in a shroud, and wherein the shield support is electrically connected to a ground connection in the plug, wherein two shielding brackets are provided as the shield support, can be detachably connected to one another and are designed such that they form a holding area for cable clamps which can be clamped in between these shielding brackets.

The refinement of the shield support according to the invention provides a holding area for commercially available cable clamps. The use of commercially available cable clamps subdivides the number of multicore, shielded cables into groups, whose cable shields are jointly electrically connected to one another by a cable clamp. These cable clamps, in each case with a group of multicore, shielded cables, are arranged in the holding areas which are formed by two shielding brackets of the shield support, and are clamped between these two shielding brackets. Since the commercially available cable clamps are composed of an electrically conductive material, the cable shields in each group of cables are electrically conductively connected to a ground potential in the contact strip, by means of the shielding brackets of the shield support. This bundling of the multicore, shielded cables into a plurality of groups of cables by means of cable clamps, in which case these cables in a group are at the same time jointly shielded, considerably enlarges the shield support in comparison to that of a known plug of a plug connector, without changing its dimensions.

In one advantageous embodiment, the two shielding brackets each have a recess for one cable clamp in each case. These cable clamps are therefore spatially fixed in the holding area of the two shielding brackets, thus making it easier to assemble a plug according to the invention.

In a further advantageous embodiment of the plug according to the invention, the recesses in each shielding bracket are arranged to be concave with respect to the contact strip in the shielding bracket. This considerably improves the guidance of the multicore, shielded cables, which are subdivided into groups, to the cable outlet in the shroud of the plug.

BRIEF DESCRIPTION OF THE DRAWING

In order to explain the invention further, reference is made to the drawing, in which one embodiment of the plug according to the invention is illustrated schematically, and in which.

DETAILED DESCRIPTION OF PREFERRED EMBODIMENTS

Figure 1:
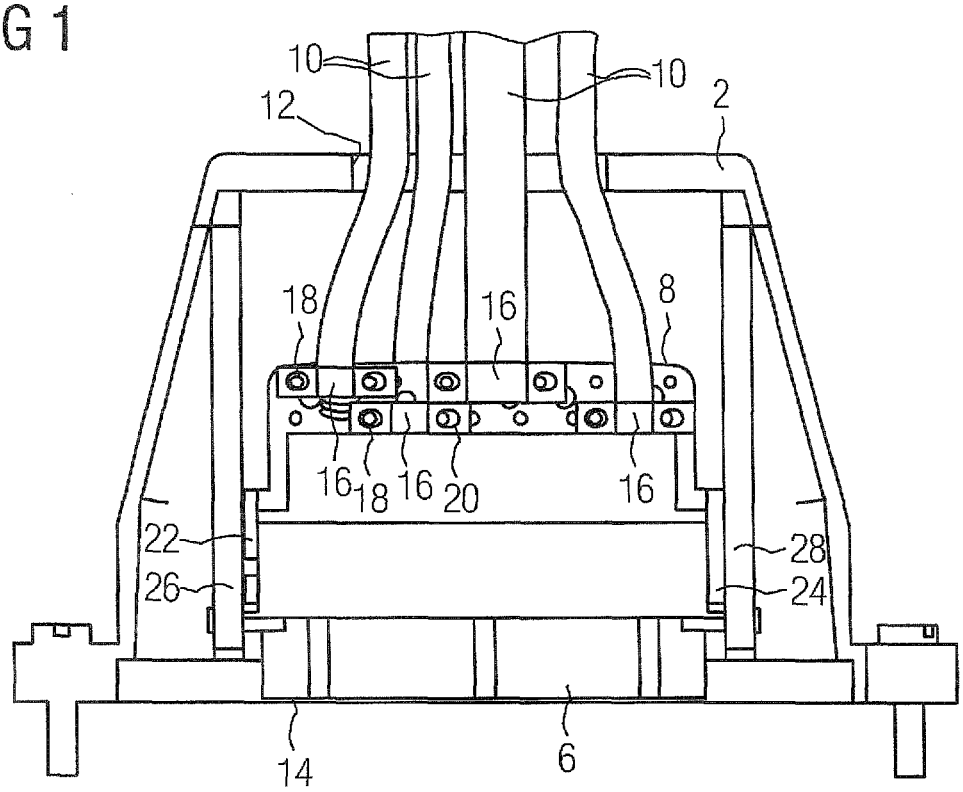
FIG. 1 shows a plug of this generic type.
Figure 2:
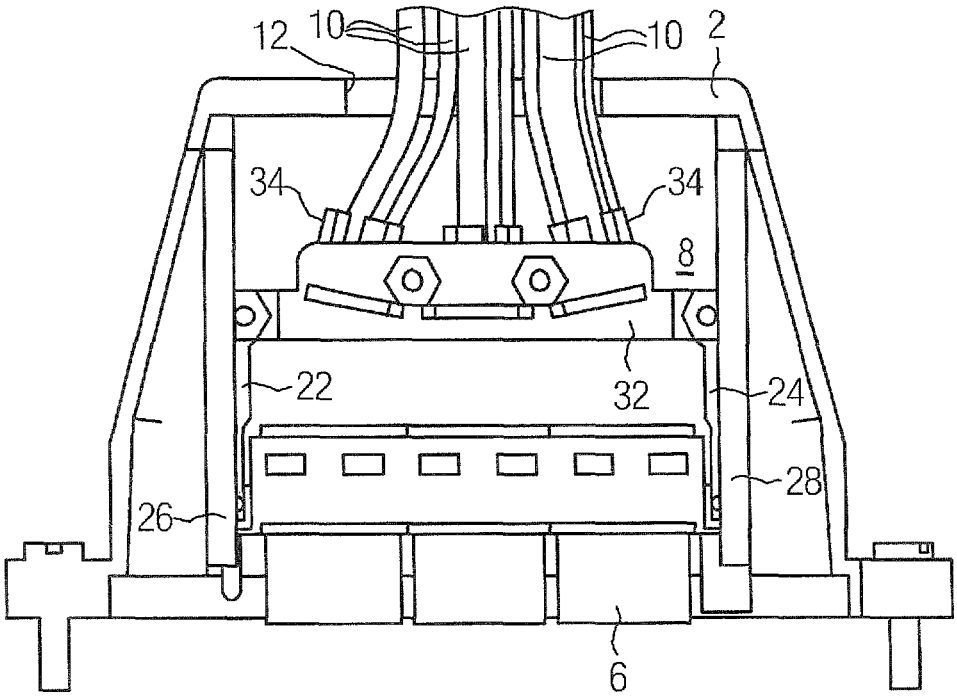
FIG. 2 shows a plug according to the invention.

FIG. 2 schematically illustrates a plug according to the invention. This plug according to the invention differs from the generic plug in that two shielding brackets 30 and 32 are provided instead of one bracket on the shield support 8. In addition, three cable clamps 34 are arranged between these two shielding brackets 30 and 32. Each cable clamp 34 is associated with a group of multicore, shielded cables 10.

Figure 3:
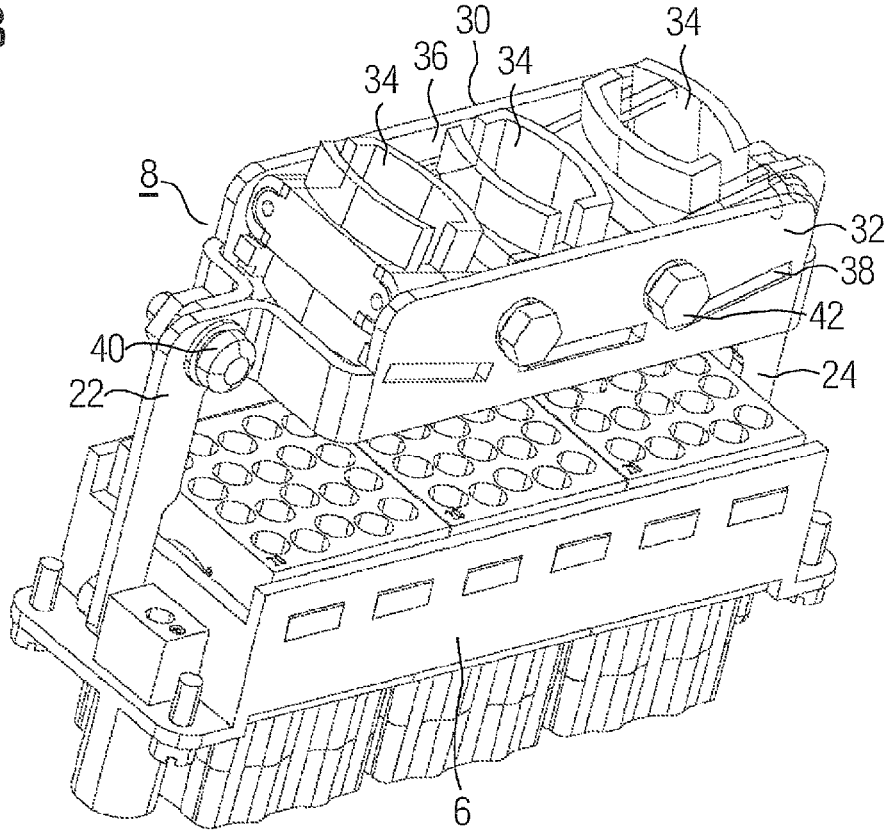
FIG. 3 shows a plug connector having a shield support according to the invention.

In order to assist understanding of the invention, FIG. 3 provides a perspective illustration of only the contact strip 6 and the shield support 8 according to the invention. This perspective illustration shows that the two shielding brackets 30 and 32 are designed such that they cover a holding area 36. Three cable clamps 34 are arranged in this holding area 36, along a concave line with respect to the contact strip 6. This improves the guidance of the multicore, shielded cables 10, which have been subdivided into groups, with respect to the recess 12 in the shroud 2 of the plug. This recess 12 in the shroud 2 forms a cable outlet from the plug.

Since the illustration in FIG. 3 shows one advantageous embodiment of the plug according to the invention, the shielding brackets 30 and 32 each have a plurality of recesses 38. Since three cable clamps 34 are used in this embodiment, one of which is illustrated in more detail in FIG. 4, each shielding bracket 30 or 32 has three recesses 38, which are arranged along a concave line with respect to the contact strip 6. The cable clamps 34 are fixed by these recesses 38 during assembly of the plug, thus simplifying this assembly process.

In the embodiment of the shield support 8 illustrated in FIG. 3, the shielding bracket 32 and the two webs 22 and 24 form a unit. The shielding bracket 30 is detachably attached to this unit. The holding area 36 for a plurality of cable clamps 34 is formed by the shape of these two shielding brackets 30 and 32. Once the cable clamps 34 have been arranged in this holding area 36 and their tabs 56 and 58 have each been plugged into corresponding recesses 38 in the two shielding brackets 30 and 32, these two shielding brackets 30 and 32 are connected to one another not only by means of a screw 40 but additionally by means of two threaded bolts 42. These threaded bolts 42 clamp the cable clamps 34 between these shielding brackets 30 and 32. Since the cable clamps 34 and the two shielding brackets 30 and 32 are each composed of electrically conductive material, this improves the electrical contact between a shielding bracket 30 or 32 and a cable clamp 34.

Figure 4:
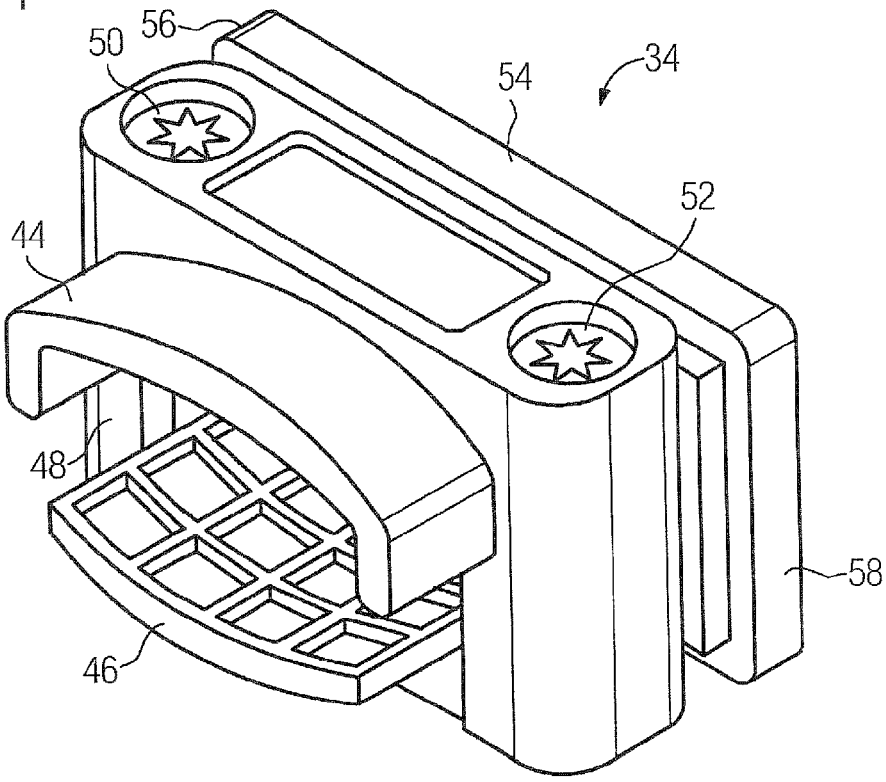
FIG. 4 shows a commercially available cable clamp.

FIG. 4 shows a commercially available cable clamp 34, which has a stationary half-shell 44 and a moving half-shell 46. These two half-shells 44 and 46 surround a bushing 48 of this cable clamp 34. Cable shields of cables 10 that are plugged through are electrically conductively connected to one another by means of these two half-shells 44 and 46, with the moving half-shell 46 being moved such that the cables which have been plugged in the bushing 48 are clamped in. For this purpose, the cable clamp 34 has two spindles 50 and 52, which can be rotated by means of an appropriate tool. The rotary movement of these two spindles 50 and 52 moves the moving half-shell 46 in the direction of the stationary half-shell 44, or in the opposite direction away from it. On the side of the cable clamp 34 which faces away from the two half-shells 44 and 46, this cable clamp 34 has a latching plate 54, which is arranged around the bushing 48 of this cable clamp 34. The latching plate 54 projects beyond the width of the cable clamp 34 at the side. This results in a tab 56 and 58 on each of the two sides, which tabs 56 and 58 engage in the recesses 38 provided in the two shielding brackets 30 and 32 of the shield support 8 of the plug, for a large number of multicore, shielded cables 10. These tabs 56, 58 on the cable clamp 34 result in the latter being held spatially in a predetermined position. In order to ensure that the cable shields of cables 10 of each cable clamp 34 are electrically conductively connected to the potential of the shielding brackets 30 and 32, these cable clamps 34 are each composed of an electrically conductive material.

The cable clamps 34 are used to subdivide the multicore, shielded cables 10 in a plug, in particular a multipole plug, into a plurality of groups of cables 10, and to adjust them between two shielding brackets 30 and 32 of a shield support 8 in the plug. This means that it is now possible to use a contact strip 6 with a large number of poles in the plug.

What is claimed is:

1. A plug of a plug connector for a plurality of multicore, shielded cables, said plug comprising:

a contact strip having contacts electrically conductively connected to lines of the multicore shielded cables;

a plurality of cable clamps subdividing the plurality of multicore, shielded cables into groups, wherein cable shields of each group are electrically connected to one another by a corresponding one of the cable clamps;

a shield support electrically conductively connected to cable shields of each group of the multicore shielded cables and electrically connected to a ground connection of the plug, said shield support being configured in the form of two shielding brackets which are detachably connected to one another and designed to form a holding area for the plurality of cable clamps which are clamped between the shielding brackets; and a hood for accommodating the contact strip and the shield support in spaced-apart relationship.

2. The plug of claim 1 constructed as a multipole plug.

3. The plug of claim 1, wherein each of the shielding brackets has a recess, each of the cable clamps being disposed in a corresponding recess of the shielding bracket, whereby the cable clamps and the recesses are placed into one-to-one correspondence.

4. The plug of claim 3, wherein the recess of each shielding bracket is arranged in concave relationship to the contact strip.

5. The plug of claim 1, further comprising two threaded bolts to secure the cable clamps between the shielding brackets.

6. The plug of claim 1, wherein each cable clamp is made of electrically conductive material.

7. The plug of claim 1, wherein the shroud has a recess to form a cable outlet.

8. The plug of claim 1, wherein the contact strip is constructed as a female connector strip.

9. The plug of claim 1, wherein the contact strip is constructed as a male connector strip.

* * * * *